US007275385B2

(12) United States Patent
Abel et al.

(10) Patent No.: US 7,275,385 B2
(45) Date of Patent: Oct. 2, 2007

(54) COMPRESSOR WITH VAPOR INJECTION SYSTEM

(75) Inventors: Gnanakumar Robertson Abel, Laguna (CN); Man Wai Wu, Hong Kong (CN); Ka Yiu Lau, Hong Kong (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 53 days.

(21) Appl. No.: 11/209,183

(22) Filed: Aug. 22, 2005

(65) Prior Publication Data

US 2007/0039347 A1 Feb. 22, 2007

(51) Int. Cl.
*F25B 13/00* (2006.01)

(52) U.S. Cl. ..... 62/324.4

(58) Field of Classification Search ..... 62/324.4, 62/114, 324.1
See application file for complete search history.

(56) References Cited

U.S. PATENT DOCUMENTS 3,589,140 A 6/1971 Osborne
3,864,934 A 2/1975 Jeding et al.
3,871,187 A 3/1975 Skvarenina
4,033,738 A 7/1977 Merola et al.
4,059,968 A 11/1977 Ross
4,369,633 A 1/1983 Snyder
4,370,868 A 2/1983 Kim et al.
4,439,114 A 3/1984 Kimmell
4,466,253 A * 8/1984 Jaster ..... 62/188
4,475,354 A 10/1984 Akerhielm et al.
4,573,327 A 3/1986 Cochran
4,665,716 A 5/1987 Cochran
4,831,843 A 5/1989 Cochran
5,069,043 A 12/1991 Wachs, III et al.
5,113,668 A 5/1992 Wachs, III et al.
5,189,885 A 3/1993 Ni
5,255,529 A * 10/1993 Powell et al. ..... 62/180
5,285,653 A 2/1994 Meloling et al.
5,431,026 A * 7/1995 Jaster ..... 62/221
5,475,986 A 12/1995 Bahel et al.
5,515,694 A 5/1996 Meloling et al.
5,605,051 A 2/1997 Iritani et al.
5,687,578 A 11/1997 Cochran
5,692,389 A 12/1997 Lord et al.
5,724,821 A 3/1998 Lord et al.
5,778,695 A 7/1998 Ring et al.
5,806,327 A 9/1998 Lord et al.
5,829,265 A 11/1998 Lord et al.
5,848,537 A 12/1998 Biancardi et al.

(Continued)

*Primary Examiner*—Melvin Jones
(74) *Attorney, Agent, or Firm*—Harness, Dickey & Pierce, P.L.C.

(57) ABSTRACT

A heat pump system includes a first heat exchanger, a second heat exchanger in fluid communication with the first heat exchanger, a scroll compressor in fluid communication with each of the first and second heat exchangers, and a flash tank in fluid communication with each of the first and second heat exchangers and the scroll compressor. The flash tank includes an inlet fluidly coupled to the first and second heat exchangers and receives liquid refrigerant from the first and second heat exchangers. The flash tank also includes a first outlet fluidly coupled to the first and second heat exchangers that delivers sub-cooled-liquid refrigerant to the second heat exchanger and a second outlet fluidly coupled to the scroll compressor that delivers vaporized refrigerant to the scroll compressor in a heating mode.

37 Claims, 3 Drawing Sheets

U.S. PATENT DOCUMENTS

| | | | | |
|---|---|---|---|---|
| 6,015,453 | A | 1/2000 | Haugen et al. | |
| 6,018,958 | A | 2/2000 | Lingelbach et al. | |
| 6,047,557 | A | 4/2000 | Pham et al. | |
| 6,070,420 | A * | 6/2000 | Biancardi et al. | 62/114 |
| 6,122,931 | A | 9/2000 | Paganessi et al. | |
| 6,213,731 | B1 | 4/2001 | Doepker et al. | |
| 6,233,962 | B1 | 5/2001 | Scherer et al. | |
| 6,385,980 | B1 | 5/2002 | Sienel | |
| 6,434,956 | B1 | 8/2002 | Ota et al. | |
| 6,474,087 | B1 | 11/2002 | Lifson | |
| 6,499,305 | B2 | 12/2002 | Pham et al. | |
| 6,530,238 | B2 | 3/2003 | Hansen | |
| 6,601,397 | B2 | 8/2003 | Pham et al. | |
| 6,619,936 | B2 | 9/2003 | Perevozchikov | |
| 6,745,584 | B2 | 6/2004 | Pham et al. | |
| 2005/0120733 | A1 * | 6/2005 | Healy et al. | 62/324.4 |

* cited by examiner

COMPRESSOR WITH VAPOR INJECTION SYSTEM

FIELD

The present teachings relate to vapor injection and, more particularly, to a heating system having an improved vapor injection system.

BACKGROUND

Heating and/or cooling systems including air-conditioning, chiller, refrigeration, and heat pump systems may include a flash tank disposed between a heat exchanger and the compressor for use in improving system capacity and efficiency. The flash tank receives liquid refrigerant from a heat exchanger and converts a portion of the liquid refrigerant into vapor for use by the compressor. Because the flash tank is held at a lower pressure relative to the inlet liquid refrigerant, some of the liquid refrigerant vaporizes, causing the remaining liquid refrigerant in the flash tank to lose heat and become sub-cooled. The resulting vapor within the flash tank is at an increased pressure and may be injected into the compressor to increase the heating and/or cooling capacity of the system.

The vaporized refrigerant from the flash tank is distributed to a medium or intermediate pressure input of the compressor. Because the vaporized refrigerant is at a substantially higher pressure than vaporized refrigerant leaving the evaporator, but at a lower pressure than an exit stream of refrigerant leaving the compressor, the pressurized refrigerant from the flash tank allows the compressor to compress this pressurized refrigerant to its normal output pressure while passing it through only a portion of the compressor.

The sub-cooled refrigerant disposed in the flash tank similarly increases the capacity and efficiency of the heat exchanger. The sub-cooled liquid is discharged from the flash tank and is sent to one of the heat exchangers depending on the desired mode (i.e., heating or cooling). Because the liquid is in a sub-cooled state, more heat can be absorbed from the surroundings by the heat exchanger, thereby improving the overall performance of the heating or cooling cycle.

The flow of pressurized refrigerant from the flash tank to the compressor is regulated to ensure that vaporized refrigerant is received by the compressor. Similarly, flow of sub-cooled-liquid refrigerant from the flash tank to the heat exchanger is regulated to inhibit flow of vaporized refrigerant from the flash tank to the heat exchanger. Both of the foregoing situations may be controlled by regulating the flow of liquid refrigerant into the flash tank. In other words, by regulating the flow of liquid refrigerant into the flash tank, the amount of vaporized refrigerant and sub-cooled-liquid refrigerant may be controlled, thereby controlling flow of vaporized refrigerant to the compressor and sub-cooled-liquid refrigerant to the heat exchanger.

SUMMARY

A heat pump system includes a first heat exchanger, a second heat exchanger in fluid communication with the first heat exchanger, a scroll compressor in fluid communication with each of the first and second heat exchangers, and a flash tank in fluid communication with each of the first and second heat exchangers and the scroll compressor. The flash tank includes an inlet fluidly coupled to the first and second heat exchangers and receives liquid refrigerant from the first and second heat exchangers. The flash tank also includes a first outlet fluidly coupled to the first and second heat exchangers that delivers sub-cooled-liquid refrigerant to the second heat exchanger and a second outlet fluidly coupled to the scroll compressor that delivers vaporized refrigerant to the scroll compressor in a heating mode.

Further areas of applicability of the present teachings will become apparent from the detailed description provided hereinafter. It should be understood that the detailed description and specific examples are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION

Figure 1:
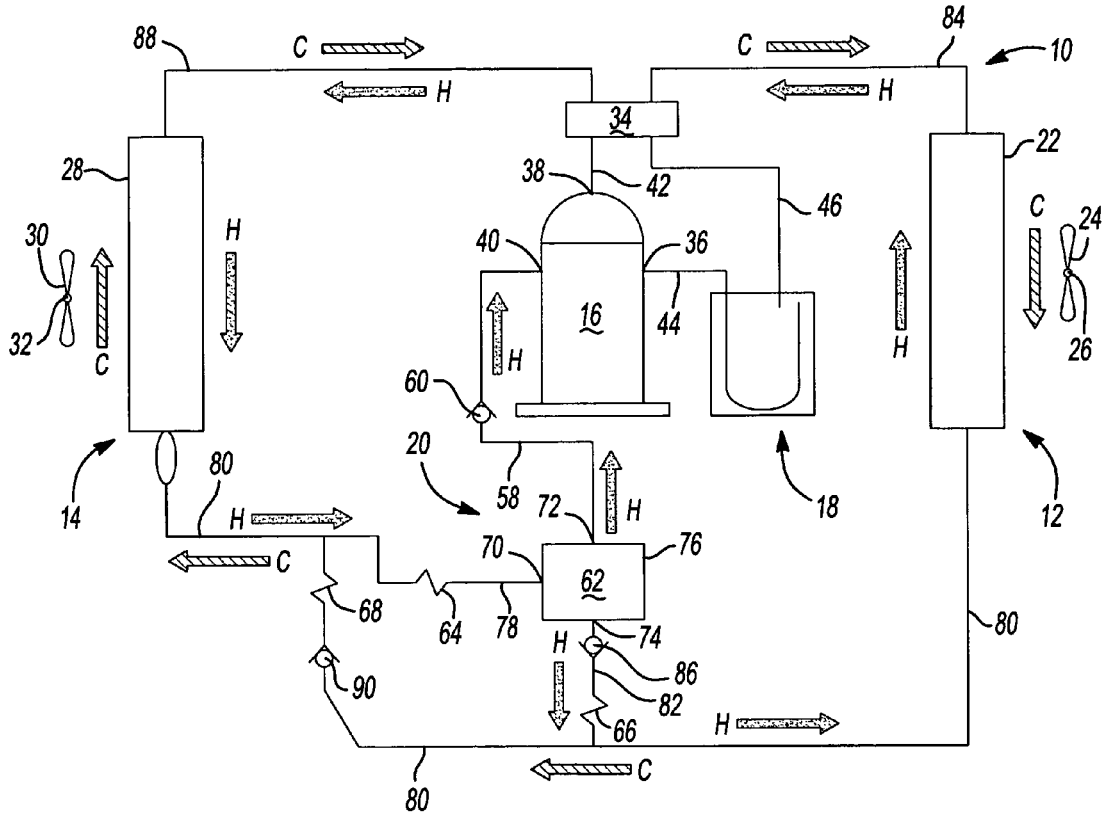
FIG. 1 is a schematic view of a heat pump system in accordance with the principles of the present teachings.

The following description is merely exemplary in nature and is in no way intended to limit the teachings, application, or uses.

Vapor injection may be used in air-conditioning, chiller, refrigeration and heat pump systems to improve system capacity and efficiency. Vapor injection systems may include a flash tank for vaporizing refrigerant supplied to a compressor and sub-cooling refrigerant supplied to a heat exchanger. Vapor injection may be used in heat pump systems, which are capable of providing both heating and cooling to commercial and residential buildings, to improve one or both of heating and cooling capacity and efficiency.

For the same reasons, flash tanks may be used in chiller applications to provide a cooling effect for water, in refrigeration systems to cool an interior space of a display case or refrigerator, and in air-conditioning systems to affect the temperature of a room or building. While heat pump systems may include a cooling cycle and a heating cycle, chiller, refrigeration and air-conditioning systems often only include a cooling cycle. However, heat pump chillers, which provide a heating and cooling cycle, are the norm in some parts of the world. Each system uses a refrigerant to generate the desired cooling or heating effect through a refrigeration cycle.

For air-conditioning applications, the refrigeration cycle is used to lower the temperature of the new space to be cooled, typically a room or building. For this application, a fan or blower is typically used to force the ambient air into more rapid contact with the evaporator to increase heat transfer and cool the surroundings.

For chiller applications, the refrigeration cycle cools or chills a stream of water. Heat pump chillers use the refrigeration cycle to heat a stream of water when operating on HEAT mode. Rather than using a fan or blower, the refrigerant remains on one side of the heat exchanger while circulating water or brine provides the heat source for evaporation. Heat pump chillers often use ambient air as the heat source for evaporation during HEAT mode but may also use other sources such as ground water or a heat exchanger that absorbs heat from the earth. Thus, the heat exchanger cools or heats the water passing therethrough as heat is transferred from the water into the refrigerant on COOL mode and from the refrigerant into the water on HEAT mode.

In a refrigeration system, such as a refrigerator or refrigerated display case, the heat exchanger cools an interior space of the device and a condenser rejects the absorbed heat. A fan or blower is often used to force the air in the interior space of the device into more rapid contact with the evaporator to increase heat transfer and cool the interior space.

In a heat pump system, the refrigeration cycle is used to both heat and cool. A heat pump system may include an indoor unit and an outdoor unit, and the indoor unit both heats and cools a room or an interior space of a commercial or residential building. The heat pump may also be of a monobloc construction with the "outdoor" and "indoor" parts combined in one frame.

As described previously, the refrigeration cycle is applicable to air conditioning, chiller, heat pump chiller, refrigeration, and heat pump systems. While each system has unique features, vapor injection may be used to improve system capacity and efficiency. That is, in each system, a flash tank receiving liquid refrigerant from a heat exchanger and converting a portion of the liquid refrigerant into vapor, may be supplied to a medium or intermediate pressure input of the compressor. The vaporized refrigerant is at a higher pressure than vaporized refrigerant leaving the evaporator, but at a lower pressure than an exit stream of refrigerant leaving the compressor. The pressurized refrigerant from the flash tank, therefore, allows the compressor to compress this pressurized refrigerant to its normal output pressure while passing it through only a portion of the compressor. Further, the sub-cooled refrigerant in the flash tank is useful to increase the capacity and efficiency of the heat exchanger.

Because the liquid discharged from the flash tank is sub-cooled, when supplied to the heat exchanger, more heat can be absorbed from the surroundings, increasing overall performance of the heating or cooling cycle. More specific examples will be provided next with reference to the drawings, but one of skill in the art should recognize that while the examples described in this application include air conditioning and heating, the teachings are applicable to other systems and certain features described with respect to a particular type of system may be equally applicable to other types of systems.

Figure 2:
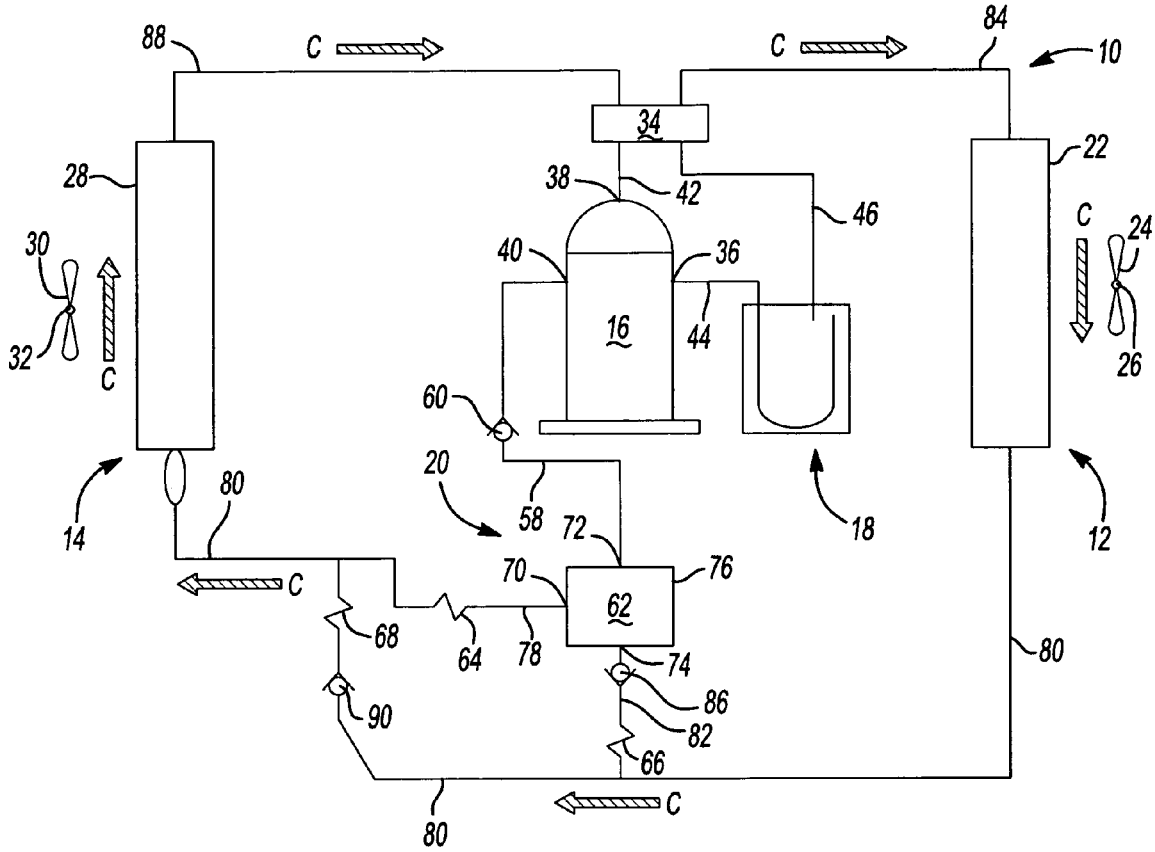
FIG. 2 is a schematic view of the heat pump system of FIG. 1 illustrating a COOL mode.
Figure 3:
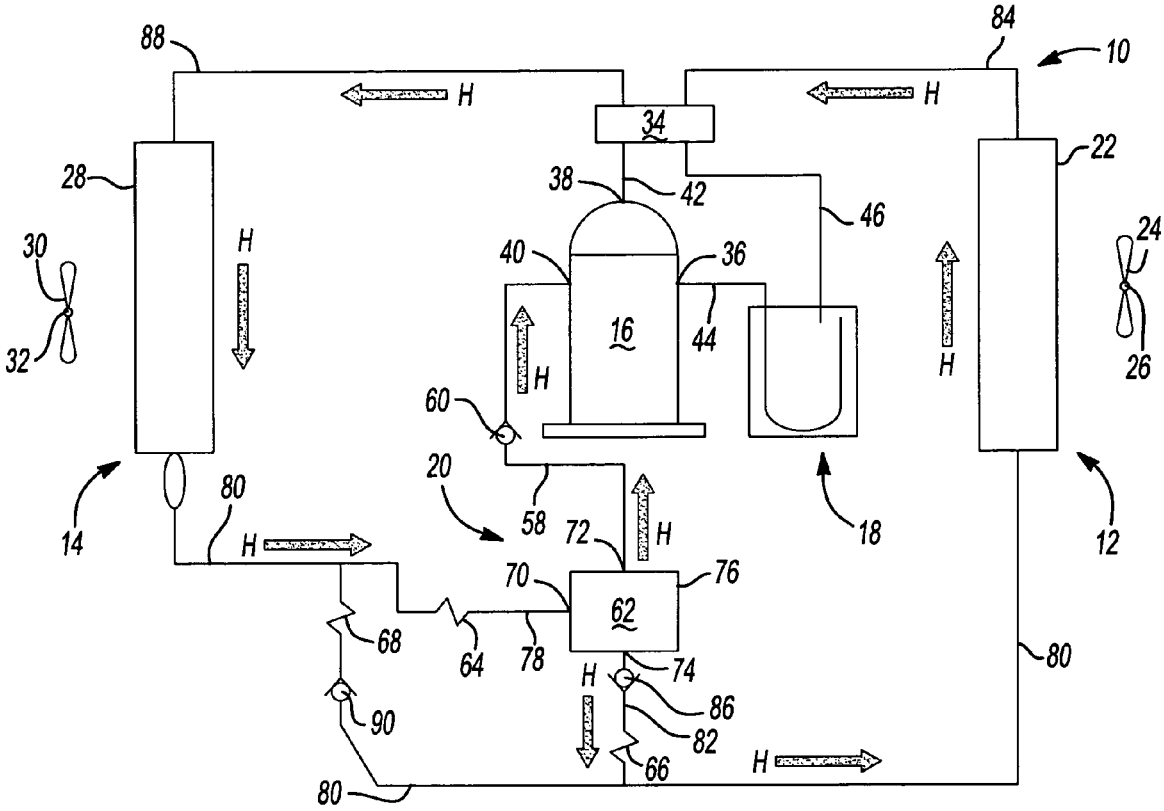
FIG. 3 is a schematic view of the heat pump system of FIG. 1 illustrating a HEAT mode.

With particular reference to FIGS. 1-3, operation of the heat pump system 10 will be described in detail. The heat pump system 10 will be described as including a COOL mode and a HEAT mode with the vapor injection system 20 providing intermediate-pressure vapor and sub-cooled liquid refrigerant during the HEAT mode and bypassed in the COOL mode. It should be understood that while the vapor injection system 20 will be described hereinafter, and shown in the drawings, as being bypassed in the COOL mode, that the vapor injection system 20 could alternatively be bypassed in the HEAT mode by simply reversing the arrangement of the system 10.

With reference to FIG. 1, a heat pump system 10 is provided and includes an outdoor unit 12, an indoor unit 14, a scroll compressor 16, an accumulator tank 18, and a vapor injection system 20. The indoor and outdoor units 12, 14 are in fluid communication with the scroll compressor 16, accumulator tank 18, and vapor injection system 20 such that a refrigerant may circulate therebetween. The refrigerant cycles through the system 10 under pressure from the scroll compressor 16 and circulates between the indoor and outdoor units 12, 14 to reject and absorb heat. As can be appreciated, whether the indoor or outdoor unit 12, 14 rejects or accepts heat will depend on whether the heat pump system 10 is set to a COOL mode or a HEAT mode, as will be discussed further below. The system may also be a HEAT only or COOL only system having a single mode of operation.

The outdoor unit 12 includes an outdoor coil or heat exchanger 22 and an outdoor fan 24 driven by a motor 26. The outdoor unit 12 includes a protective housing that encases the outdoor coil 22 and outdoor fan 24 so that the fan 24 will draw ambient outdoor air across the outdoor coil 22 to improve heat transfer. In addition, the outdoor unit 12 usually houses the scroll compressor 16 and accumulator tank 18. While outdoor unit 12 has been described as including a fan 24 to draw ambient air across the coil 22, it should be understood that any method of transferring heat from the coil 22, such as burying the coil 22 below ground or passing a stream of water around the coil 22, is considered within the scope of the present teachings.

The indoor unit 14 includes an indoor coil or heat exchanger 28 and an indoor fan 30 driven by a motor 32, which may be a single-speed, two-speed, or variable-speed motor. The indoor fan 30 and coil 28 are enclosed in a cabinet so that the fan 30 forces ambient indoor air across the indoor coil 28 at a rate determined by the speed of the variable speed motor 32. As can be appreciated, such air flow across the coil 28 causes heat transfer between the ambient indoor surroundings and the indoor coil 28. In this regard, the indoor coil 28, in conjunction with the indoor fan 30 selectively raises or lowers the temperature of the indoor surroundings. Again, while a fan 30 is disclosed, it should be understood that in a chiller application, heat is transferred from a stream of water directly to the refrigerant and, as such, may obviate the need for the fan 30.

The heat pump system 10 as shown includes a four-way reversing valve 34 in order to provide both cooling and heating by simply reversing the function of the indoor coil 28 and the outdoor coil 22. The system may alternatively be a HEAT only or COOL only system having a single mode of operation, in which case a four-way reversing valve 34 may be unnecessary. For a system providing both heating and cooling, when the four-way valve 34 is set to the COOL mode, the indoor coil 28 functions as an evaporator coil and the outdoor coil 22 functions as a condenser coil. Conversely, when the four-way valve 34 is switched to the HEAT mode (the alternate position), the function of the coils 22, 28 is reversed, i.e., the indoor coil 28 functions as the condenser and the outdoor coil 22 functions as the evaporator.

When the indoor coil 28 acts as an evaporator, heat from the ambient-indoor surroundings is absorbed by the liquid refrigerant moving through the indoor coil 28. Such heat transfer between the indoor coil 28 and the liquid refrigerant cools the surrounding indoor air. Conversely, when the indoor coil 28 acts as a condenser, heat from the vaporized refrigerant is rejected by the indoor coil 28, thereby heating the surrounding indoor air.

The scroll compressor 16 may be housed within the outdoor unit 12 and pressurizes the heat pump system 10 such that refrigerant is circulated throughout the system 10. The scroll compressor 16 includes a suction port 36, a discharge port 38, and a vapor injection port 40. The discharge port 38 is fluidly connected to the four-way valve 34 by a conduit 42 such that pressurized refrigerant may be distributed to the outdoor and indoor units 12, 14 via four-way valve 34. The suction port 36 is fluidly coupled to the accumulator tank 18 via conduit 44 such that the scroll compressor 16 draws refrigerant from the accumulator tank 18 for compression.

The scroll compressor 16 receives refrigerant at the suction port 36 from the accumulator tank 18, which is fluidly connected to the four-way valve 34 via conduit 46. In addition, the accumulator tank 18 receives refrigerant from the outdoor and indoor units 12, 14 for compression by the scroll compressor 16. The accumulator tank 18 stores low-pressure refrigerant received from the outdoor and indoor coils 22, 28 and protects the compressor 16 from receiving refrigerant in the liquid state.

The vapor injection port 40 is fluidly coupled to the vapor injection system 20 via conduit 58 and receives pressurized refrigerant from the vapor injection system 20. A check valve 60 may be provided on conduit 58 generally between the vapor injection port 40 and the vapor injection system 20 to prevent refrigerant from flowing from the vapor injection port 40 to the vapor injection system 20.

The vapor injection system 20 produces pressurized vapor at a higher-pressure level than that supplied by the accumulator tank 18, but at a lower pressure than produced by the scroll compressor 16. After the pressurized vapor reaches a heightened pressure level, the vapor injection system 20 may deliver the pressurized refrigerant to the scroll compressor 16 via vapor injection port 40. By delivering pressurized-vapor refrigerant to the scroll compressor 16, system capacity and efficiency may be improved. Such an increase in efficiency may be even more pronounced when the difference between the outdoor temperature and the desired indoor temperature is relatively large (i.e., during hot or cold weather).

With reference to FIG. 1, the vapor injection system 20 is shown to include a flash tank 62, an inlet expansion device 64, an outlet expansion device 66, and a cooling expansion device 68. It should be noted that while each of the expansion devices 64, 66, 68 will be described as, and are shown as, capillary tubes, that the expansion devices 64, 66, 68 may alternatively be a solenoid valve, a thermal expansion valve, or an electronic expansion valve.

The flash tank 62 includes an inlet port 70, a vapor outlet 72, and a sub-cooled-liquid outlet 74, each fluidly coupled to an interior volume 76. The inlet port 70 is fluidly coupled to the outdoor and indoor units 12, 14 via conduits 78, 80. The vapor outlet 72 is fluidly coupled to the vapor injection port 40 of the scroll compressor 16 via conduit 58 while the sub-cooled-liquid outlet 74 is fluidly coupled to the outdoor and indoor units 12, 14 via conduits 82, 80.

When the heat pump system 10 is set to the COOL mode (FIG. 2), the vapor injection system 20 is bypassed such that vapor is not injected at the vapor injection port 40 of the compressor 16 and sub-cooled liquid refrigerant is not supplied to the indoor heat exchanger 28.

In the COOL mode, the scroll compressor 16 imparts a suction force on the accumulator tank 18 to draw vaporized refrigerant into the scroll compressor 16. Once the vapor is sufficiently pressurized, the high-pressure refrigerant is discharged from the scroll compressor 16 via discharge port 38 and conduit 42. The four-way valve 34 directs the pressurized refrigerant to the outdoor unit 12 via conduit 84. Upon reaching the outdoor coil 22, the refrigerant releases stored heat due to the interaction between the outside air, the coil 22, and the pressure imparted by the scroll compressor 16. After the refrigerant has released a sufficient amount of heat, the refrigerant changes phase from a gaseous or vaporized phase to a liquid phase.

After the refrigerant has changed phase from gas to liquid, the refrigerant moves from the outdoor coil 22 to the indoor coil 28 via conduit 80. A check valve 86 is poisoned along conduit 82 to prevent the liquid refrigerant from entering the flash tank 62 at outlet 74. Sub-cooled liquid refrigerant from the flask tank 62 does not mix with the liquid refrigerant from the outdoor coil 22 as the liquid refrigerant from the outdoor coil 22 is at a higher pressure than the sub-cooled liquid refrigerant.

Capillary tube 68 is disposed generally between the outdoor unit 12 and the indoor unit 14 along conduit 80. The capillary tube 68 lowers the pressure of the liquid refrigerant due to interaction between the moving liquid refrigerant and the inner walls of the capillary tube 68. The lower pressure of the liquid refrigerant expands the refrigerant prior to reaching the indoor unit 14 and begins to transition back to the gaseous phase.

Part of the low-pressure refrigerant exiting capillary tube 68 enters the inlet 70 of the flash tank 62 through conduit 78 when the system 10 is initially started. The low-pressure refrigerant continues to fill the flash tank 62 until the pressure within the flash tank 62 equalizes with the exit pressure of the capillary tube 68. The refrigerant does not enter vapor injection port 40 of the compressor 16 as the pressure of the refrigerant is higher than the capillary tube 68 exit pressure. Therefore, the internal volume 76 of the flash tank 62 serves as a storage vessel during the COOL mode. Because there is not a continuous flow of vapor from the flash tank 62 to the vapor injection port 40 of the compressor 16, sub-cooled liquid refrigerant is not generated within the flash tank 62. Stored low-pressure refrigerant (i.e., sub-cooled liquid refrigerant) does not mix with refrigerant flowing in conduit 80 through the outlet 74 of the flash tank 62*n* during the COOL mode, as previously discussed.

Upon reaching the indoor unit 14, the liquid refrigerant enters the indoor coil 28 to complete the transition from the liquid phase to the gaseous phase. The liquid refrigerant enters the indoor coil 28 at a low pressure (due to the interaction of the capillary tube 68, as previously discussed) and absorbs heat from the surroundings. As the fan 30 passes air through the coil 28, the refrigerant absorbs heat and completes the phase change, thereby cooling the air passing through the indoor coil 28 and, thus, cooling the surroundings. Once the refrigerant reaches the end of the indoor coil 28, the refrigerant is in a low-pressure gaseous state. At this point, the suction from the scroll compressor 16 causes the refrigerant to return to the accumulator tank 18 via conduit 88 and four-way valve 34.

When the heat pump system 10 is set to the HEAT mode (FIG. 3), the vapor injection system 20 provides vapor at intermediate pressure to the vapor injection port 40 of the scroll compressor 16 and sub-cooled liquid refrigerant to the outdoor heat exchanger 22.

In the HEAT mode, the scroll compressor 16 imparts a suction force on the accumulator tank 18 to draw vaporized refrigerant into the scroll compressor 16. Once the vapor is sufficiently pressurized, the high-pressure refrigerant is discharged from the scroll compressor 16 via discharge port 38 and conduit 42. The four-way valve 34 directs the pressurized refrigerant to the indoor unit 14 via conduit 88. Upon reaching the indoor coil 28, the refrigerant releases stored heat due to the interaction between the inside air, the coil 28, and the pressure imparted by the scroll compressor 16 and, as such, heats the surrounding area. Once the refrigerant has released a sufficient amount of heat, the refrigerant changes phase from the gaseous or vaporized phase to a liquid phase.

Once the refrigerant has changed phase from gas to liquid, the refrigerant moves from the indoor coil 28 to the outdoor coil 22 via conduits 80 and 78. The liquid refrigerant first travels along conduit 80 until reaching a check valve 90. The check valve 90 restricts further movement of the liquid refrigerant along conduit 80 from the indoor coil 28 to the outdoor coil 22. In so doing, the check valve 90 causes the liquid refrigerant to flow into conduit 78 and encounter capillary tube 64.

The capillary tube 64 expands the refrigerant from the indoor coil 28 prior to the refrigerant entering the flash tank 62 at inlet 70. Expansion of the refrigerant causes the refrigerant to begin to transition from the liquid phase to the gaseous phase. As the liquid refrigerant flows through the inlet 70, the interior volume 76 of the flash tank 62 begins to fill. The entering liquid refrigerant causes the fixed interior volume 76 to become pressurized as the volume of the flash tank 62 is filled.

Once the liquid refrigerant reaches the flash tank 62, the liquid releases heat causing some of the liquid refrigerant to vaporize and some of the liquid to enter a sub-cooled-liquid state. At this point, the flash tank 62 has a mixture of both vaporized refrigerant and sub-cooled-liquid refrigerant. The vaporized refrigerant is at a higher pressure than that of the vaporized refrigerant leaving the coils 22, 28 but at a higher pressure than the vaporized refrigerant leaving the discharge port 38 of the scroll compressor 16.

The vaporized refrigerant exits the flash tank 62 via the vapor outlet 72 and is fed into the vapor injection port 40 of the scroll compressor 16. The pressurized vapor-refrigerant allows the scroll compressor 16 to deliver an outlet refrigerant stream with a desired output pressure, thereby improving the overall efficiency of the system 10.

The sub-cooled-liquid refrigerant exits the flash tank 62 via outlet 74 and reaches the outdoor unit 12 via conduits 82, 80. The sub-cooled-liquid refrigerant leaves outlet 74 and encounters capillary tube 66, which expands the liquid refrigerant prior to reaching the outdoor coil 22 to improve the ability of the refrigerant to extract heat from the outside. Once the refrigerant absorbs heat from the outside via outdoor coil 22, the refrigerant once again returns to the gaseous stage and return to the accumulator tank 18 via conduit 84 and four-way valve 34 to begin the cycle again.

As described, the heat pump system 10 provides a vapor injection system 20 for use during a HEAT mode. The vapor injection system 20 is bypassed during a COOL mode of the system 10 such that sub-cooled liquid refrigerant is not received by the indoor unit during cooling. It should be understood, however, that the heat pump system 10 may alternatively include a vapor injection system 20 for use during a COOL mode such that the vapor injection system 20 may be bypassed in the HEAT mode by simply reversing the arrangement of the system.

The description of the teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A heat pump system comprising:

a first heat exchanger operable to pass refrigerant in a first flow direction and a second flow direction;

a second heat exchanger in fluid communication with said first heat exchanger and operable to pass refrigerant in said first flow direction and said second flow direction;

a scroll compressor in fluid communication with each of said first and second heat exchangers and operable to compress refrigerant in said first flow direction and said second flow direction; and a fluid circuit including a flash tank and a bypass conduit, said flash tank having an intake conduit and a first outlet conduit in fluid communication with said first and second heat exchangers and operable to deliver sub-cooled-liquid refrigerant to said second heat exchanger in said first flow direction, said bypass conduit disposed between said intake conduit and said first outlet conduit and operable to create a pressure differential between said bypass conduit and said flash tank to prevent flow of sub-cooled liquid refrigerant to said first heat exchanger in said second flow direction.

2. The heat pump system of claim 1, further comprising an expansion device disposed in said bypass conduit and operable to reduce a pressure of refrigerant in said second flow direction.

3. The heat pump system of claim 1, wherein said expansion device is one of a capillary tube, a thermal expansion valve, or an electronic expansion valve.

4. The heat pump system of claim 1, wherein said scroll compressor includes a vapor injection port in fluid communication with said flash tank and operable to receive vaporized refrigerant in said first flow direction.

5. The heat pump system of claim 4, further comprising a check valve disposed between said vapor injection port and said flash tank to prevent refrigerant flow from said vapor injection port to said flash tank.

6. The heat pump system of claim 1, further comprising a four-way valve disposed at an outlet of said scroll compressor and operable to direct refrigerant in said first flow direction and said second flow direction to selectively toggle the heat pump between heating and cooling functions.

7. The heat pump system of claim 1, wherein said first flow direction is one of a heating mode and a cooling mode.

8. The heat pump system of claim 7, wherein said second flow direction is the other of said heating mode and said cooling mode.

9. The heat pump system of claim 1, further comprising an expansion device disposed between said first heat exchanger and said flash tank.

10. The heat pump system of claim 9, wherein said expansion device is one of a capillary tube, a solenoid valve, a thermal expansion valve, and an electronic expansion valve.

11. The heat pump system of claim 1, wherein said first heat exchanger is one of a condenser and an evaporator.

12. The heat pump system of claim 11, wherein said second heat exchanger is the other of said condenser and said evaporator.

13. The heat pump system of claim 1, further comprising an expansion device disposed proximate to said outlet conduit of said flash tank.

14. The heat pump system of claim 13, wherein said expansion device is one of a capillary tube, a solenoid valve, a thermal expansion valve, and an electronic expansion valve.

15. The heat pump system of claim 1, wherein said flash tank includes a vapor injection conduit fluidly coupled to said scroll compressor and operable to deliver vaporized refrigerant to said scroll compressor in said first flow direction.

16. In a heat pump system of the type which re-circulates refrigerant through a fluid circuit between a first heat exchanger and a second heat exchanger including a scroll compressor coupled to the fluid circuit, a vapor injection system comprising:

a flash tank having an intake conduit and a first outlet conduit in fluid communication with said first and second heat exchangers and operable to deliver sub-cooled-liquid refrigerant to said second heat exchanger in a first flow direction; and a bypass conduit disposed between said intake conduit and said first outlet conduit and operable to create a pressure differential between said bypass conduit and said flash tank to prevent flow of sub-cooled liquid refrigerant to said first heat exchanger in a second flow direction.

17. The vapor injection system of claim 16, further comprising an expansion device disposed in said bypass conduit and operable to reduce a pressure of refrigerant in said second flow direction.

18. The vapor injection system of claim 16, wherein said expansion device is one of a capillary tube, a thermal expansion valve, or an electronic expansion valve.

19. The vapor injection system of claim 16, wherein said scroll compressor includes a vapor injection port in fluid communication with said flash tank and operable to receive vaporized refrigerant in said first flow direction.

20. The vapor injection system of claim 19, further comprising a check valve disposed between said vapor injection port and said flash tank to prevent refrigerant flow from said vapor injection port to said flash tank.

21. The vapor injection system of claim 16, further comprising a four-way valve disposed at an outlet of said scroll compressor and operable to direct refrigerant in said first flow direction and said second flow direction to selectively toggle the vapor injection between heating and cooling functions.

22. The vapor injection system of claim 16, wherein said first flow direction is one of a heating mode and a cooling mode.

23. The vapor injection system of claim 22, wherein said second flow direction is the other of said heating mode and said cooling mode.

24. The vapor injection system of claim 16, further comprising an expansion device disposed between said first heat exchanger and said flash tank.

25. The vapor injection system of claim 24, wherein said expansion device is one of a capillary tube, a solenoid valve, a thermal expansion valve, and an electronic expansion valve.

26. The vapor injection system of claim 16, wherein said first heat exchanger is one of a condenser and an evaporator.

27. The vapor injection system of claim 26, wherein said second heat exchanger is the other of said condenser and said evaporator.

28. The vapor injection system of claim 16, further comprising an expansion device disposed proximate to said outlet conduit of said flash tank.

29. The vapor injection system of claim 28, wherein said expansion device is one of a capillary tube, a solenoid valve, a thermal expansion valve, and an electronic expansion valve.

30. The vapor injection system of claim 16, wherein said flash tank includes a vapor injection conduit fluidly coupled to said scroll compressor and operable to deliver vaporized refrigerant to said scroll compressor in said first flow direction.

31. A heat pump system operable between a heating mode and a cooling mode, the heat pump system comprising:

a first heat exchanger;

a second heat exchanger in fluid communication with said first heat exchanger;

a scroll compressor in fluid communication with each of said first and second heat exchangers;

a flash tank in fluid communication with each of said first and second heat exchangers and said scroll compressor, said flash tank including an inlet fluidly coupled to said first and second heat exchangers, a first outlet fluidly coupled to said first and second heat exchangers, and a second outlet fluidly coupled to said scroll compressor and operable to deliver vaporized refrigerant to said scroll compressor in a first mode; and an expansion device disposed between said second heat exchanger and said first heat exchanger and operable to reduce refrigerant to said flash tank to prevent said flash tank from providing vaporized refrigerant to said scroll compressor in a second mode.

32. The heat pump system of claim 31, wherein said expansion device is one of a capillary tube, a solenoid valve, a thermal expansion valve, and an electronic expansion valve.

33. The heat pump system of claim 31, further comprising a check valve disposed proximate to said first outlet of said flash tank to prevent refrigerant from flowing into said first outlet.

34. The heat pump system of claim 31, further comprising an expansion device disposed proximate to said first outlet.

35. The heat pump system of claim 34, wherein said expansion device is one of a capillary tube, a solenoid valve, a thermal expansion valve, and an electronic expansion valve.

36. The heat pump system of claim 31, wherein said first mode is one of a cooling mode and a heating mode.

37. The heat pump system of claim 36, wherein said second mode is the other of said cooling mode and said heating mode.

* * * * *